US005114606A

United States Patent [19]

van Vliet et al.

[11] Patent Number: 5,114,606

[45] Date of Patent: May 19, 1992

[54] BLEACHING COMPOSITION COMPRISING AS A BLEACHING CATALYST A COMPLEX OF MANGANESE WITH A NON-CARBOXYLATE POLYHYDROXY LIGAND

[75] Inventors: Marten R. P. van Vliet, Haarlem; Jan E. Iburg, Vlaardingen, both of Netherlands

[73] Assignee: Lever Brothers Company, Division of Conopco, Inc., New York, N.Y.

[21] Appl. No.: 657,582

[22] Filed: Feb. 19, 1991

[30] Foreign Application Priority Data

Feb. 19, 1990 [GB] United Kingdom ..... 9003741

[51] Int. Cl.[5] ..... C11D 3/95; C11D 3/04; C11D 7/04; D06L 3/02

[52] U.S. Cl. ..... 252/103; 252/95; 252/156; 252/186.1; 252/186.33; 502/152; 502/156; 502/171; 502/103; 8/111; 8/137

[58] Field of Search ..... 502/152, 156, 171, 103; 252/102, 103, 95, 99, 97, 111, 186, 156, 186.1, 186.33; 8/111, 137

[56] References Cited

U.S. PATENT DOCUMENTS

| | | | |
|---|---|---|---|
| 3,156,654 | 11/1964 | Konecny et al. | 252/99 |
| 3,532,634 | 10/1970 | Woods | 252/99 |
| 4,110,074 | 8/1978 | Finley et al. | 252/186 |
| 4,111,651 | 9/1978 | Blumbergs et al. | 8/111 |
| 4,115,058 | 9/1978 | Blumbergs et al. | 252/95 |
| 4,115,059 | 9/1978 | Blumbergs et al. | 252/186 |
| 4,115,060 | 9/1978 | Finley et al. | 252/186 |
| 4,120,651 | 10/1978 | Erickson et al. | 8/111 |
| 4,120,652 | 10/1978 | Scholer et al. | 252/97 |
| 4,124,356 | 11/1978 | Blumbergs et al. | 252/97 |
| 4,128,490 | 12/1978 | Finley et al. | 252/99 |
| 4,133,637 | 1/1979 | Blumbergs et al. | 252/95 |
| 4,164,394 | 8/1979 | Brubaker et al. | 252/95 |
| 4,164,395 | 8/1979 | Finley et al. | 252/95 |
| 4,169,805 | 10/1979 | Blumbergs et al. | 8/111 |
| 4,170,566 | 10/1979 | Finley et al. | 252/103 |
| 4,194,987 | 3/1980 | Brubaker | 252/102 |
| 4,202,786 | 5/1980 | Brubaker | 252/102 |
| 4,207,070 | 6/1980 | Finley et al. | 252/95 |
| 4,210,551 | 7/1980 | Brubaker | 252/99 |
| 4,212,757 | 7/1980 | Brubaker et al. | 252/99 |
| 4,215,003 | 7/1980 | Finley et al. | 252/99 |
| 4,225,451 | 9/1980 | McCrudden et al. | 252/99 |
| 4,230,591 | 10/1980 | Finley et al. | 252/99 |
| 4,620,935 | 11/1986 | Baxter et al. | 252/99 |
| 4,626,373 | 12/1986 | Finch et al. | 252/96 |
| 4,728,455 | 3/1988 | Rerek | 252/99 |
| 4,794,195 | 12/1988 | Hayashi et al. | 502/152 |
| 4,810,410 | 3/1989 | Diakun et al. | 252/99 |
| 4,992,194 | 2/1991 | Liberati et al. | 252/99 |

FOREIGN PATENT DOCUMENTS

| | | |
|---|---|---|
| 0072166 | 2/1983 | European Pat. Off. . |
| 0120591 | 10/1984 | European Pat. Off. . |
| 0141470 | 5/1985 | European Pat. Off. . |
| 0174132 | 3/1986 | European Pat. Off. . |
| 0185522 | 6/1986 | European Pat. Off. . |
| 0284292 | 9/1988 | European Pat. Off. . |
| 0331229 | 9/1989 | European Pat. Off. . |
| 0836988 | 7/1956 | United Kingdom . |
| 0864798 | 4/1961 | United Kingdom . |
| 0907356 | 10/1962 | United Kingdom . |
| 1003310 | 9/1965 | United Kingdom . |
| 1519351 | 7/1978 | United Kingdom . |

OTHER PUBLICATIONS

JACS 1979 "Richens Reference" 101-3681 to 3683.

*Primary Examiner*—A. Lionel Clingman
*Assistant Examiner*—Erin Higgins
*Attorney, Agent, or Firm*—Milton L. Honig

[57] ABSTRACT

A stable and effective manganese complex for use as a peroxy compound bleach catalyst is disclosed, the catalyst being a water-soluble complex of manganese (II), (III), or (IV) or mixtures thereof with a ligand which is a non-carboxylate polyhydroxy compound having at least three consecutive C—OH groups in its molecular structure. Bleaching composition comprising a peroxy compound and the catalyst, as well as process for bleaching substrates using said catalyst are also disclosed. Preferred ligand is sorbitol and preferred catalyst is Mn-sorbitol complex.

14 Claims, No Drawings

BLEACHING COMPOSITION COMPRISING AS A BLEACHING CATALYST A COMPLEX OF MANGANESE WITH A NON-CARBOXYLATE POLYHYDROXY LIGAND

FIELD OF THE INVENTION

This invention relates to activation of peroxide compound bleaches, including hydrogen peroxide or a hydrogen peroxide adduct, which liberate hydrogen peroxide in aqueous solution, such as alkali metal perborates, percarbonates, perphosphates, persilicates etc., as well as peroxy acids; to compounds that activate or catalyze peroxy compounds; to bleach compositions including detergent bleach compositions which contain a catalyst for peroxy compounds; and to processes for bleaching and/or washing of substrates employing the aforementioned types of compositions.

BACKGROUND OF THE INVENTION

In particular, the present invention is concerned with the effective use of a manganese complex as catalyst for the bleach activation of peroxy compound bleaches.

Peroxide bleaching agents for use in laundering have been known for many years. Such agents are effective in removing stains, such as tea, fruit and wine stains, from clothing at or near boiling temperatures. The efficacy of peroxide bleaching agents drops off sharply at temperatures below 60° C.

It is known that many transition metal ions, including manganese ions, catalyze the decomposition of $H_2O_2$ and $H_2O_2$-liberating percompounds, such as sodium perborate. It has also been suggested that transition metal salts together with a co-ordinating ligand (i.e. a chelating agent) can be used to activate peroxide compounds so as to make them usable for satisfactory bleaching at lower temperatures. Not all combinations of transition metals with ligands appeared to be suitable for improving the bleaching performance of peroxide compound bleaches.

Many combinations indeed show no effect, or even a worsening effect, on the bleaching performance; no proper rule seems to exist by which the effect of metal ion/ligand combinations on the bleaching performance of peroxide compound bleaches can be predicted.

Various attempts have been made to select suitable metal/chelating agent combinations for said purpose and to correlate bleach-catalyzing effect with some physical constants of the combination; so far without much success and of no practical value.

U.S. Pat. No. 3,156,654 suggested transition metals, though particularly cobalt andcopper salts, in conjunction with pyridine-2-carboxylic acid or pyridine-2,6-dicarboxylic acid, preferably as a preformed complex, as being a suitable combination. Another suggestion is made in U.S. Pat. No. 3,532,634 to use a transition metal salt, together with a chelating agent in combination with a persalt and an organic bleach activator. It is said here that the chelating agent should have a first complex formation constant with the transition metal ion of log 2 to about log 10 at 20° C. Preferred options include (di)-picolinic acid, pyrrolidine-carboxylic acids and 1,10-phenanthroline, whereas well-known chelating agents, such as ethylene diamine tetraacetic acid—found usable according to U.S. Pat. No 3,156,654 —are unsuitable.

Other patent documents discussing the combined use of ligands or chelating agents with manganese are, for example, EP-A-0072166 and EP-A-0141470, which suggested the use of pre-complexed manganese cation with specific chelating agents, particularly of the class of (poly)amino polycarboxylates.

All these prior art suggestions are based on systems in which free metal ion is the catalytically active species and consequently produce results in practice that are often very inconsistent and/or unsatisfactory, especially when used for washing at low temperatures.

For a transition metal in general and manganese in particular to be useful as a bleach catalyst in a detergent bleach composition, the transition metal, i.e. manganese, must not unduly promote peroxide decomposition by non-bleaching pathways and must be hydrolytically and oxidatively stable. The first requirement is with respect to the often dark-colored metal (hydr)oxide formation, the second requirement, for example, upon addition of hypochlorite or other oxidants.

U.S. Pat. No 4,728,455 discusses the use of catalysts for peroxide bleach based on a combination of Mn(III) and the hydroxycarboxylic acids that can form complexes at the preferred Mn-to-ligand ratios which are stable with respect to hydrolysis and oxidation. An example of this type of catalyst is Mn(III)-gluconate. Although a large series of hydroxyl-containing compounds is claimed, at least one carboxylic acid group or its salt is always present in the ligands.

The importance of the carboxylate group to obtain stable metal complexes with these types of ligands was furthermore suggested by M. van Duin et al; the carboxylate group functions as a promoter of the acidity of the hydroxyl proton of the OH-group adjacent to the carboxylate group, thereby improving participation in the co-ordination of the metal ion. [M. van Duin, J.A. Peters, A.P.G. Kieboom and H. van Bekkum, Recueil de Travaux chimiques des Pays-Bas, 108/2, Feb. 1989].

The above-mentioned patent and scientific literature strongly suggests that the carboxylate group be an essential part of the ligand to obtain stable complexes.

SUMMARY OF THE INVENTION

We have now surprisingly found that the presence of a carboxylate group in polyalcohols is not an essential part of the molecule for bleach catalysis. If this carboxylate group is replaced by an OH-group, Mncomplexes are obtained with excellent catalytic activity and similar or even better stability to prevent Mn-oxide or Mn-hydroxide formation as a result of alkaline hydrolysis or oxidation, as compared with the Mncatalysts described in the art.

Polyalcohol-type of ligands, e.g. $R'-(CH_2OH)_n—R''$, without a carboxyl group present, form co-ordination complexes with manganese cations in either the II, III or IV oxidation state with high-stability constants. The absence of the carboxyl group does not appear to be a constraint for co-ordination. On the contrary, in the high pH regions, co-ordination via the deprotonated and negatively charged alkanolate oxygen anion, seems to be stronger than co-ordination via the carboxylate anionic oxygen atom.

The Mn-polyol complexes can be prepared with Mn(III) or with Mn(IV). Spectroscopic studies, however, show that in the detergent solution all three Mn(II), Mn(III) and Mn(IV) complexes can be present.

It is therefore an object of the present invention to provide an improved catalyst for the bleach activation of hydrogen peroxide and hydrogen peroxide-liberating compounds, as well as peroxyacid compounds, including peroxyacid precursors, over a wide class of stains at lower temperatures.

Another object of the invention is to provide an improved bleaching composition which is effective at low to medium temperatures of e.g. 20°–40° C.

Still another object of the invention is to provide new, improved detergent bleach formulations.

Yet another object of the invention is to provide aqueous laundry wash media containing new, improved detergent bleach formulations.

A further object of the invention is to provide an improved bleaching system comprising a peroxide compound bleach and a manganese complex catalyst for the effective use in the textile and paper industries and other related industries.

These and other objects of the invention, as well as further understandings of the features and advantages thereof, can be had from the following description.

DETAILED DESCRIPTION

The improved manganeses complex bleach catalyst according to the invention is a water-soluble complex of Mn, either Mn(II), Mn(III) or Mn(IV) or mixtures thereof with a ligand, wherein said ligand is a non-carboxylate polyhydroxy compound having at least three consecutive C—OH groups in its molecular structure.

Both linear and cyclic molecules are suitable compounds to form the ligand, which may be simple unsubstituted polyhydroxy compounds or may contain any substituent(s) other than carboxylate, such as alkyl, aryl, alkene, amine, aldehyde, ethylene oxide, ether, sugar groups and the like.

Preferred ligands are those that contain at least 5 consecutive carbon atoms, preferably from 5 to 8, having at least 4 consecutive hydroxyl groups, preferably from 4 to 8.

The ligand can be a linear or a cyclic polyol. Examples of linear polyols are sorbitol, xylitol, mannitol, ribitol, erythrol and arabitol. Examples of cyclic polyols are inositol, scyllitol, lactose, glucose and stereoisomers thereof. Of these, sorbitol is the preferred ligand on the basis of stability constants and easiness of availability. An example of an Mn-sorbitol complex is as shown in Example I.

The molar ratio of ligand to Mn in the manganese complex bleach catalyst and in the bleaching solution is especially important. The ratio should be at least 1:1 and preferably from 5:1 to about 100:1, although higher ratios can be used. A particularly preferred ratio is from 20:1 to 50:1. These ratios maintain Mn in the Mn-ligand complex as the catalytically active species, thereby also minimizing wasteful decomposition of peroxygen bleach and the risk of brown staining by $MnO_2$ formation.

An advantage of the bleach catalysts of the invention is that they are hydrolytically and oxidatively stable and that the complexes are catalytically active and based on Mn, a transition metal, which is considered to be safe and environmentally acceptable. Another advantage is that the ligands are readily available, relatively cheap and naturally occurring materials. They are furthermore active in a wide variety of detergent formulations and are not affected by strong sequestrants, such as ethylene diamine tetraacetic acid and the aminopolyphosphonates, under in-use conditions.

Accordingly, in one aspect the invention provides a bleaching and cleaning process employing a peroxy compound bleaching agent, which proceeds is characterized in that said bleaching agent is activated by a catalytic amount of a complex of Mn with a polyhydroxy ligand as defined hereinbefore.

The catalytic component is a novel feature of the invention. The effective level of the catalyst component, expressed in terms of parts per million (ppm) of Mn in the aqueous bleaching/cleaning solution normally ranges from 0.05 to 5 ppm, preferably from 0.5 to 2.5 ppm. Depending on the conditions used, wasteful decomposition of the peroxygen bleach may become predominant if the level of Mn in solution is above 5 ppm.

In another aspect, the invention provides an improved bleaching composition comprising a peroxy compound bleach as defined above and a catalyst for the bleaching action of the peroxy compound bleach, said catalyst comprising a complex of Mn with a non-carboxylate polyhydroxy ligand as hereinbefore defined. As indicated above, the improved bleaching composition has particular application in detergent formulations to form a new and improved detergent bleach composition within the purview of the invention, comprising said peroxy compound bleach, the aforesaid Mn complex catalyst, a surface-active material, and usually also detergency builders and other known ingredients of such formulations.

The Mn catalyst will be present in the detergent formulations in amounts so as to provide the required level in the wash liquor. When the dosage of the detergent bleach composition is relatively low, e.g. about 1 to 2 g/l by consumers in Japan and USA, respectively, the Mn content in the formulation will normally be in the range of 0.0025 to 0.5%, preferably from 0.025 to 0.25% by weight. At higher product dostage as used e.g. by European consumers, the Mn content in the formulation may be in the range of 0.005 to 0.1%, preferably from 0.005 to 0.05% by weight. For all Mn contents in the formulation, the Mn to ligand ratio is as described above.

Compositions comprising a peroxy compound bleach and the aforesaid bleach catalyst are effective over a pH range of between 8 and 13, with optimal pH range lying between 9 and 11.

The peroxide compound bleaches which can be utilized in the present invention include hydrogen peroxide, hydrogen peroxide-liberating compounds, peroxyacids, and peroxyacid bleach precursors and mixtures thereof.

Hydrogen peroxide sources are well known in the art. They include the alkali metal peroxides, organic peroxide bleaching compounds such as urea peroxide, and inorganic persalt bleaching compounds, such as the alkali metal perborates, percarbonates, perphosphates and persulphates. Mixtures of two or more such compounds may also be suitable. Particularly preferred are sodium percarbonate and sodium perborate and, especially, sodium perborate monohydrate. Sodium perborate monohydrate is preferred to tetrahydrate because of its excellent storage stability while also dissolving very quickly in aqueous bleaching solutions. Sodium percarbonate may be preferred for environmental reasons. These bleaching compounds may be utilized alone or in conjunction with a peroxyacid bleach precursor.

Peroxyacid bleach precursors are known and amply described in literature, such as in the GB Patents 836,988; 864,798; 907,356; 1,003,310 and 1,519,351; German Patent 3,337,921; EP-A0185522; EP-A-0174132;

EP-A-0120591; and U.S. Pat. Nos. 1,246,339; 3,332,882; 4,128,494; 4,412,934 and 4,675,393.

Another useful class of peroxyacid bleach precursors is that of the quaternary ammonium substituted peroxyacid precursors as disclosed in U.S. Pat. Nos. 4,751,015 and 4,397,757, in EP-A-284292 and EP-A-331,229. Examples of peroxyacid bleach precursors of this class are:

2-(N,N,N-trimethyl ammonium) ethyl sodium-4-sulphophenyl carbonate chloride-(SPCC);

N-ocytl,N,N-dimethyl-N10-carbophenoxy decyl ammonium chloride-(ODC);

3-(N,N,N-trimethyl ammonium) propyl sodium-4-sulphophenyl carboxylate; and

N,N,N-trimethyl ammonium toluyloxy benzene sulphonate.

Of the above classes of bleach precursors, the preferred classes are the esters, including acyl phenol sulphonates and acyl alkyl phenol sulphonates; acylamides; and the quaternary ammonium substituted peroxyacid precursors.

Highly preferred activators include sodium-4-benzoyloxy benzene sulphonate; N,N,N',N'-tetraacetyl ethylene diamine; sodium-1-methyl-2-benzoyloxy benzene-4-sulphonate; sodium-4-methyl-3-benzoyloxy benzoate; SPCC; trimethyl ammonium toluyloxy benzene sulphonate; sodium nonanoyloxybenzene sulphonate and sodium 3,5,5-trimethyl hexanoyloxybenzene sulphonate.

A detergent bleach composition of the invention can be formulated by combining effective amounts of the components. The term "effective amounts" as used herein means that the ingredients are present in quantities such that each of them is operative for its intended purpose when the resulting mixture is combined with water to form an aqueous medium which can be used to wash and clean clothes, fabrics and other articles.

In particular, the detergent bleach composition can be formulated to contain, for example, about 5% to 30% by weight, preferably from 10 to 25% by weight, of a peroxide compound. Peroxyacids may be utilized in somewhat lower amounts, for example from 1% to about 15% by weight, preferably from 2% to 10% by weight.

Peroxyacid precursors may be utilized in combination with a peroxide compound in approximately the same level as peroxyacids, i.e. 1% to 15%, preferably from 2% to 10% by weight.

The manganese complex catalyst will be present in such formulations in amounts so as to provide the required level of Mn in the wash liquor. Normally, an amount of manganese complex catalyst is incorporated in the formulation which corresponds to a Mn content of from 0.005% to about 0.5% by weight, preferably 0.025% to 0.1% by weight.

The bleach catalyst of the invention is compatible with substantially any known and common surface-active agents and detergency builder materials.

The surface-active material may be naturally derived or a synthetic material selected from anionic, nonionic, amphoteric, zwitterionic, cationic actives and mixtures thereof. Many suitable actives are commercially available and are fully described in literature, for example in "Surface Active Agents and Detergents", Volumes I and II, by Schwartz, Perry and Berch. The total level of the surface-active material may range up to 50% by weight, preferably being from about 1% to 40% by weight of the composition, most preferably 4 to 25% by weight.

Synthetic anionic surface-actives are usually water-soluble alkali metal salts of organic sulphates and sulphonates having alkyl groups containing from about 8 to about 22 carbon atoms, the term alkyl being used to include the alkyl portion of higher aryl groups.

Examples of suitable synthetic anionic detergent compounds are sodium and ammonium alkyl sulphates, especially those obtained by sulphating higher ($C_8$–$C_{18}$) alcohols produced, for example, from tallow or coconut oil; sodium and ammonium alkyl ($C_9$–$C_{20}$) benzene sulphonates, particularly sodium linear secondary alkyl ($C_{10}$-$C_{15}$) benzene sulphonates; sodium alkyl glyceryl ether sulphates, especially those esters of the higher alcohols derived from tallow or coconut oil and synthetic alcohols derived from petroleum; sodium coconut oil fatty acid monoglyceride sulphates and sulphonates; sodium and ammonium salts of sulphuric acid esters of higher ($C_9$–$C_{18}$) fatty alcohol alkylene oxide, particularly ethylene oxide, reaction products; the reaction products of fatty acids such as coconut fatty acids esterified with isethionic acid and neutralized with sodium hydroxide; sodium and ammonium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolyzing with a base to produce a random sulphonate; sodium and ammonium $C_7$–$C_{12}$ dialkyl sulfosuccinates; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkylbenzene sulphonates, sodium ($C_{16}$–$C_{18}$) alkyl sulphates and sodium ($C_{16}$–$C_{18}$) alkyl ether sulphates.

Examples of suitable nonionic surface-active compounds which may be used, include in particular the reaction products of alkylene oxides, usually ethylene oxide, with alkyl ($C_6$–$C_{22}$) phenols, generally 5–25 EO, i.e. 5–25 units of ethylene oxides per molecule; the condensation products of aliphatic ($C_8$–$C_{18}$) primary or secondary linear or branched alcohols with ethylene oxide, generally 3–30 EO, and products made by condensation of ethylene oxide with the reaction products of propylene oxide and ethylene diamine. Other so-called nonionic surface-actives include alkyl polyglycosides, long chain tertiary amine oxides, long chain tertiary phosphine oxides and dialkyl sulphoxides.

Amounts of amphoteric or zwitterionic surface-active compounds can also be used in the compositions of the invention but this is not normally desired owing to their relatively high cost. If any amphoteric or zwitterionic detergent compounds are used, it is generally in small amounts in compositions based on the much more commonly used synthetic anionic and nonionic actives.

The detergent compositions of the invention will normally also contain a detergency builder. Builder materials may be selected from 1) calcium sequestrant materials 2) precipitating materials, 3) calcium ion-exchange materials and 4) mixtures thereof.

Examples of calcium sequestrant builder materials include alkali metal polyphosphates, such as sodium tripolyphosphate; nitrilotriacetic acid and its water-soluble salts; the akali metal salts of ether polycarboxylates, such as carboxymethyloxy succinic acid, oxydisuccinic acid, mellitic acid; ethylene diamine tetraacetic acid; benzene polycarboxylic acids; citric acid; and polyacetal carboxylates as disclosed in U.S. Pat. Nos. 4,144,226 and 4,146,495.

Examples of precipitating builder materials include sodium orthophosphate, sodium carbonate and sodium carbonate/calcite.

Examples of calcium ion-exchange builder materials include the various types of water-insoluble crystalline or amorphous aluminosilicates, of which zeolites are the best known representatives.

In particular, the compositions of the invention may contain any one of the organic or inorganic builder materials, such as sodium or potassium tripolyphosphate, sodium or potassium pyrophosphate, sodium or potassium orthophosphate, sodium carbonate or sodium carbonate/calcite mixtures, the sodium salt of nitrilotriacetic acid, sodium citrate, carboxymethyl malonate, carboxymethyloxy succinate and the water-insoluble crystalline or amorphous aluminosilicate builder materials, or mixtures thereof.

These builder materials may be present at a level of, for example, from 5 to 80% by weight, preferably from 10 to 60% by weight.

Apart from the components already mentioned, the detergent compositions of the invention can contain any of the conventional additives in the amounts in which such materials are normally employed in fabric washing detergent compositions. Examples of these additives include lather boosters, such as alkanolamides, particularly the monoethanol amides derived from palmkernel fatty acids and coconut fatty acids, lather depressants, such as alkyl phosphates and silicones, anti-redeposition agents, such as sodium carboxymethyl cellulose and alkyl or substituted alkyl cellulose ethers, other stabilizers, such as ethylene diamine tetraacetic acid and the phosphonic acid derivatives (i.e. Dequest ® types), fabric softening agents, inorganic salts, such as sodium sulphate, and, usually present in very small amounts, fluorescent agents, perfumes, enzymes, such as proteases, cellulases, lipases and amylases, germicides and colourants.

Another optional but highly desirable additive ingredient with multi-functional characteristics in detergent compositions is from 0.1% to about 3% by weight of a polymeric material having a molecular weight of from 1,000 to 2,000,000 and which can be a homo- or copolymer of acrylic acid, maleic acid, or salt or anhydride thereof, vinyl pyrrolidone, methyl- or ethyl-vinyl ethers, and other polymerizable vinyl monomers. Preferred examples of such polymeric materials are polyacrylic acid or polyacrylate; polymaleic acid/ acrylic acid copolymer; 70:30 acrylic acid/hydroxyethyl maleate copolymer; 1 1 styrene/maleic acid copolymer; isobutylene/maleic acid and diisobutylene/maleic acid copolymers; methyl- and ethyl-vinylether/maleic acid copolymers; ethylene/maleic acid copolymer; polyvinyl pyrrolidone; and vinyl pyrrolidone/maleic acid copolymer.

Detergent bleach compositions of the invention formulated as free-flowing particles, e.g. in powdered or granulated form, can be produced by any of the conventional techniques employed in the manufacture of detergent compositions, but preferably by slurry-making and spray-drying processes to form a detergent base powder to which the heat-sensitive ingredients including the peroxy compound bleach and optionally some other ingredients as desired, and the bleach catalyst, can be added as dry substances. Alternatively, the bleach catalyst can be added separately to a wash/bleach water containing the peroxy compound bleaching agent.

The instant bleach catalyst can also be formulated in detergent bleach compositions of other product forms, such as flakes, tablets, bars and liquids, particularly non-aqueous liquid detergent compositions.

Such non-aqueous liquid detergent compositions in which the instant bleach catalyst can be incorporated are known in the art and various formulations have been proposed, e.g. in U.S. Pat. Nos. 2,864,770; 3,368,977; 4,772,412; GB Patents 1,205,711; 1,370,377; 2,194,536; DE-A-2,233,771 and EP-A-0,028,849.

The following Examples are given to further illustrate the invention.

EXAMPLE I

Preparation of catalysts Synthesis of $[Mn^{IV}(C_6H_8(OH)4O_2)_3](n\text{-}Bu_4N)_2$ (1) "Mn-Sorbitol"

Compound 1 was synthesized according to a slightly adapted version of Sawyers preparation (ref. JACS 1979-101-3681), starting from $Mn^{II}(ClO_4)_2$, and K $Mn^{VII}O_4$. Tetra n-butyl ammonium hydroxide was used instead of tetramethyl ammonium hydroxide. In a typical example 1.06 g (2.93 mmol) of $Mn^{II}(ClO_4)2.6H_2O$ and 2.665 g (14.6 mol) of sorbitol were dissolved in a mixture of 20 ml MeOH and 15 ml water. The other ingredients, i.e. 0.308 g KMn04 (1.95 mmol) and 13.39 g of a 25% solution of n-$Bu_4NOH$ (13.7 mmol) were dissolved in 55 ml MeOH. This solution was added slowly (I5 min.) to the stirred solution of $Mn(ClO_4)_2$ and sorbitol After stirring for an additional 16 h, the solution was filtered. The methanol fraction of the red-brown solution was evaporated and the remaining white precipitate ($Bu_4N$ $ClO_4$) filtered off. To the remaining red solution 100 ml ethylacetate was added to precipitate 1. The manganese-sorbitol complex appeared to be very hygroscopic and has to be stored moisture-free in a nitrogen atmosphere. Yield 45% based on manganese The UV-vis spectra are similar to those reported in literature.

Preparation of Mn-polyol bleach solutions

Most of the bleach experiments were carried out with Mn-polyol systems prepared "in situ". As a typical example the preparation of a stock solution containing $6\cdot10^{-4}$ moles of Mn/sorbitol (1/50) is described. The whole procedure is carried out in brown glassware (to prevent photocatalyzed redox processes) 0.1187 g $MnCl_2\cdot4H_2O$ ($M_w$ =197.84, $6\cdot10^{-4}$ moles) and 5.46 g sorbitol $C_6H_8(OH)_6$ (Mw=182, $3\cdot10^{-2}$ moles) were dissolved in 90 ml demineralized water (pH 6). After 5 minutes, 0.2 g NaOH, dissolved in 10 ml demineralized water, was added with vigorous stirring. After an additional 5 minutes, air was bubbled through the solution for about 15 minutes. The clear solution containing the catalyst with manganese in the oxidation states III and IV (according to UV-vis spectroscopy) has to be stored in the dark in the refrigerator and can serve as a stock solution for at least several weeks. All other Mn-based polyol catalysts were prepared according to the aforedescribed procedure.

EXAMPLE II

The Experiments

The bleach performance experiments were either carried out in a temperature-controlled glass beaker equipped with a magnetic stirrer, thermocouple and a pH-electrode, or under real washing machine conditions.

Glass vessel experimental conditions

Isothermal experiments were carried out at 40° C. In the "heat up" experiments, the suds were heated up from 20° to 40° C. in 13 min. and then kept at that temperature for another 37 min, simulating a 50 min. 40° C. wash.

In some experiments, hardened up demineralized water (16° FH) was applied. A Ca/Mg stock solution Ca : Mg = 4:1 (weight ratio) was used to adjust water hardness.

The dosages amounted to 6 g/l total formulation (unless indicated otherwise). The composition of the base powders used is described below.

The amount of sodium perborate monohydrate was 15% (calculated on 6 g/l dosage), yielding 9 mmol/l $H_2O_2$ (unless indicated otherwise).

In most cases the catalysts were dosed at a concentration of 0.5 mg/l of metal.

Tea-stained cotton test cloth was used as bleach monitor. After rinsing in tap water, the cloths were dried in a tumble drier. ΔR460* is the difference in reflectance as measured before and after washing on a Zeiss Elrephometer. The average was taken of 4 values/test cloth.

Washing machine experiments

The washing powder (base formulation +sodium perborate monohydrate) was carefully dosed into a Miele W 736 to avoid mechanical loss. After water intake, the catalyst was added to the suds as a freshly prepared solution in 10 ml demineralized water. The conditions were :

| | |
|---|---|
| Programme | 40° C. main wash only |
| Dosage | 5 g/l |
| Water | 15 l tap water; 16° FH |
| Temperature-time profile | 20° C. → 40° C. in 12 min., 38 min. at 40° C. |
| pH | 10.5 at 20° C.; 10.0 at 40° C. |
| Load | 3.5 kg soiled or clean cotton load |

All other experimental conditions were as described above for the experiments in glass vessels.

EXAMPLE III

This Example shows the effect of catalyst concentration on bleach performance.

Conditions

Molar ratio Mn : Sorbitol =1:20; pH 10.5; Temp. =40.C, isothermal; $[H_2O_2]=17.2\times 10^{-3}$ mol/l and demineralized water; time = 30 min.

Results

| Catalyst [Mn] concentration | Δ $R_{460}$* value |
|---|---|
| 0 | 6.8 |
| $1\times 10^{-7}$ mol/l | 9.3 |
| $5\times 10^{-6}$ mol/l | 13.5 |
| $1\times 10^{-5}$ mol/l | 15.1 |
| $2\times 10^{-5}$ mol/l | 16.1 |
| $3\times 10^{-5}$ mol/l | 18.3 |
| $4\times 10^{-5}$ mol/l | 15.4 |
| $5\times 10^{-5}$ mol/l | 10.5 |
| $10^{-4}$ mol/l | 7.0 |

Conclusion

The results show the strong catalytic effect already at very low concentrations and over a wide concentration range.

EXAMPLE IV

This Example shows the effect of Mn/polyol molar ratio on bleach performance.

Conditions

=30 min., $[Mn]=1.10^{-5}$ mol/l, $[H_2O_2]=17.2\times 10^{-3}$ mol/l demineralized water, pH = 10.5, 40° C., isothermal.

Results:

| Ratio | Δ$R_{460}$* value |
|---|---|
| 1:1.1 | 15.0 |
| 1:2 | 15.7 |
| 1:3 | 12.3 |
| 1:5 | 15.0 |
| 1:10 | 15.1 |
| 1:20 | 15.1 |
| 1:30 | 15.1 |
| 1:50 | 16.1 |
| 1:100 | 16.2 |

Conclusions

The results clearly demonstrate the wide ratio area applicable for bleach catalysis. However, in the lower ratio area, i.e. 1/1 to 1/5, the catalytic system is very sensitive to minor changes in formulation etc., whereas the system is less sensitive in the higher ratio areas.

EXAMPLE V

This Example shows the bleach performance of different Mn-polyol combinations.

Conditions $[Mn]=10^{-5}$ mol/l, $[H_2O_2]=17.2\times 10^{-3}$ mol/l, pH =10.5, Mn/polyol =1:25, T =40° C. and t =30 minutes.

Results

| Polyol-ligand | $R_{460}$* values |
|---|---|
| Sorbitol | 15.1 |
| Iditol | 15.3 |
| Dulsitol | 14.4 |
| Mannitol | 15.7 |
| Xylithol | 16.5 |
| Arabitol | 15.9 |
| Adonitol | 15.1 |
| Meso-Erythritol | 14.1 |
| Meso-Inositol | 16.2 |
| Lactose | 13.4 |

Conclusion

The results show that almost the same bleach performance is obtained with a whole series of polyol ligands.

EXAMPLE VI

This Example shows the influence of different $H_2O_2$ concentrations on bleach performance.

Conditions $[Mn]=1.10^{-5}$ mol/l, Mn/Sorbitol =1/20, T=40° C., t =30 min.

| $H_2O_2$ concentration | Δ$R_{460}$* values Catalyst − | + |
|---|---|---|
| $1.10^{-3}$ mol/l | 0.0 | 0.6 |
| $4.10^{-3}$ mol/l | 3.0 | 6.1 |

-continued

| $H_2O_2$ concentration | $\Delta R_{460}$* values Catalyst − | + |
|---|---|---|
| 8.6 $10^{-3}$ mol/1 | 4.2 | 10.9 |
| 17.2 $10^{-3}$ mol/1 | 6.8 | 14.3 |
| 25.8 $10^{-3}$ mol/1 | 8.9 | 15.6 |
| 34.4 $10^{-3}$ mol/1 | 7.1 | 17.2 |
| 50.0 $10^{-3}$ mol/1 | 7.5 | 19.4 |

Conclusions

The results show that the catalytic system performs better than the non-catalyzed system over the whole concentration range of hydrogen peroxide from $10^{-3}$ to $5 \cdot 10^{-2}$ mol/1.

EXAMPLE VII

This Example examines the effect of pH on the bleach performance.

Conditions

[Mn]=1.10$^{-5}$ mol/1, Mn/Sorbitol =1/20, [H202]=17.2×10$^{-3}$ mol/1, 40° C. isothermal demineralized water, t =30 min.

Results

| Catalyst | pH | $\Delta R_{460}$* values |
|---|---|---|
| − | 9.5 | 2.1 |
| + | 9.5 | 3.6 |
| − | 10.0 | 3.4 |
| + | 10.0 | 8.3 |
| − | 10.5 | 6.8 |
| + | 10.5 | 15.1 |
| − | 11.0 | 11.9 |
| + | 11.0 | 19.9 |
| − | 11.5 | 13.6 |
| + | 11.5 | 20.6 |

Conclusion

The results clearly show the good catalytic bleach performance over a wide pH range.

EXAMPLE VIII

This Example shows that bleach catalysis is also possible with other $H_2O_2$ sources, i.e. with hydrogen peroxide (liquid) and with a percarbonate salt.

Conditions pH =10.5; [$H_2O_2$]=17.2×10$^{-3}$ mol/1; [Mn]=10$^{-5}$ mol/1; Mn/Sorbitol =1/20; t =30 min.; T =40° C.; isothermal; (Ionic strength =0.03 in all cases via $Na_2SO_4$).

Results

| $H_2O_2$ source | $\Delta R_{460}$* values |
|---|---|
| $H_2O_2$ liquid | 13.6 |
| Sodium perborate | 15.5 |
| Sodium percarbonate | 13.8 |

The results show that different $H_2O_2$ sources are applicable.

EXAMPLE IX

This Example shows the bleach performance of the Mn-polyol catalytic system in a complete base powder formulation* during heat-up cycles in glass vessels.

Conditions

[Hhd $2O_2$]=7.5×10$^{-3}$ mol/1, [Mn]=2.10-5 mol/1, Mn/Sorbitol =1/25; pH =10.5; dosage powder 6 g/1, 16° FH (Ca:Mg =4:1).

Results

| Catalyst | $\Delta R_{460}$* value |
|---|---|
| − | 8.5 |
| + | 14.6 |

Conclusion

In a complete detergent formulation, the bleach performance is considerably increased by the addition of the Mn-sorbitol complex catalyst.

* Nominal base powder composition (in % bv weioht)

18% zeolite
10% carbonate
3% silicate
0.2% fluorescer
0.5% SCMC (sodium carboxymethyl cellulose)
3% anti-foam granules
8% citrate
15% nonionics 3 EO/7 EO 1:1 * Ethylene diamine tetra-(methylene phosphonate)

EXAMPLE X

This example shows the bleach performance in a real machine wash experiment with either a clean or a normally soiled wash load. For comparison, the bleach performance of a current bleach activator system (TAED/perborate) is also given.

Conditions

Initial pH =10.5, 16.FH tap water, water intake 15 l/run, dosage 5 g/l formulation [MN]=4.10$^{-5}$, Mn/Sorbitol 1/50, TAED/ perborate/Dequest 2.3%/7.5%/0.3% pH =10 initially, 40 C MWO; 3.5 kg soiled load.

| | | % by weight |
|---|---|---|
| Base Powder (nominal composition) | | |
| Zeolite | | 28.0 |
| $Na_2$ carbonate | | 10.0 |
| Sodium disilicate | | 3.0 |
| Anti-foam | | 3.0 |
| SCMC | | 0.5 |
| Fluorescer | | 0.2 |
| Synperonic ® A3/A7 (nonionic) | | 7.5 |
| Bleach | | |
| i) | Perborate-mono(PBM) 98% Dequest ® | 15.0/0.075 |
| ii) | TAED/PBM/Dequest ® 97%/98%/90% | 2.3/7.5/0.3 |
| iii) | Perborate-mono(PBM) 98% | 15.0 |

Results:

| Bleach system | | load | $\Delta R_{460}$* value |
|---|---|---|---|
| i) | perborate alone | clean | 5.4 |
| | | soiled | 3.2 |
| ii) | TAED/perborate/Dequest ® | clean | 8.1 |
| | | soiled | 3.7 |
| iii) | Mn catalyst + perborate | clean | 9.3 |
| | | soiled | 6.5 |

Although a slight reduction in bleach performance is observed in the soiled load washes, the results demonstrate the superior performance of the catalytic system of the invention over perborate along and over the current TAED system in both clean and soiled load wash experiments.

We claim:

1. A fabric bleaching composition comprising a peroxy compound bleach present in an effective amount to achieve a bleaching action and a catalyst for the bleaching action of said peroxy compound, wherein said catalyst is a water-soluble complex of manganese (II), (III) or (IV) or mixtures thereof present in an amount of from 0.0005% to about 0.5% by weight, with a ligand present in an effective amount to complex with said manganese which is a non-carboxylate polyhydroxy having at least three consecutive C—OH groups in its molecular structure.

2. A composition according to claim 1, wherein said non-carboxylate polyhydroxy compound ligand contains at least 5 consecutive carbon atoms having at least 4 consecutive hydroxyl groups.

3. A composition according to claim 2, wherein said ligand contains from 5 to 8 consecutive carbon atoms having 4 to 8 consecutive hydroxyl groups.

4. A composition according to claim 3, wherein said ligand is sorbitol.

5. A composition according to claim 1, wherein the molar ratio of ligand to manganese in the manganese complex bleach catalyst is at least 1:1.

6. A composition according to claim 5,,wherein said molar ratio is from 5:1 to 100:1.

7. A composition according to claim 1, comprising :

(i) from 5 to 30% by weight of a peroxide compound;

(ii) said water-soluble manganese polyol complex bleach catalyst in an amount corresponding to 0.0005 to about 0.5% by weight of manganese;

(iii) from 0–50% by weight of a surface-active material; and (iv) from 0 to 80% by weight of a builder material.

8. A fabric bleaching and cleaning process comprising contacting a fabric with a peroxy compound present in an effective to cause bleaching, said compound being bleaching agent activated by a catalytic amount of a water-soluble complex of manganese (II), (III) or (IV) or mixtures thereof present in an amount of from 0.005% to about 0.5% by weight, with a ligand, present in an effective amount to complex with said peroxy compound, wherein said ligand is a non-carboxylate polyhydroxy compound having at least three consecutive C-OH groups in its molecular structure.

9. A process according to claim 8, wherein said non-carboxylate polyhydroxy compound ligand contains at least 5 consecutive carbon atoms having at least 4 consecutive hydroxyl groups.

10. A process according to claim 9, wherein said ligand contains from 5 to 8 consecutive carbon atoms having 4 to 8 consecutive hydroxyl groups.

11. A process according to claim 10, wherein the ligand is sorbitol.

12. A process according to claim 1, wherein the molar ratio of ligand to manganese in the manganese complex bleach catalyst is from 1:1 to 100:1.

13. A process according to claim 8 wherein the manganese complex catalyst is used in the aqueous bleaching/cleaning solution at a level within a range of from 0.05 to 5 ppm of manganese.

14. A process according to claim 13, wherein the level of manganese is from 0.5 to 2.5 ppm.

* * * * *